US005956862A

United States Patent [19]

Bondi

[11] Patent Number: 5,956,862

[45] Date of Patent: Sep. 28, 1999

[54] MULTIPOSITIONAL SUPPORT FOR A HAIR DRYER

[76] Inventor: Leonard J. Bondi, 1596 Calle Destuarda, San Jose, Calif. 95118

[21] Appl. No.: 09/137,232

[22] Filed: Aug. 20, 1998

[51] Int. Cl.[6] ..... A45D 20/00

[52] U.S. Cl. ..... 34/97; 34/90; 34/91; 248/314; 248/289.11

[58] Field of Search ..... 34/90, 91, 96, 34/97; 248/314, 316.5, 316.7, 289.11, 274.1

[56] References Cited

U.S. PATENT DOCUMENTS

| | | | |
|---|---|---|---|
| 4,642,909 | 2/1987 | Garcia | 34/97 |
| 4,659,907 | 4/1987 | Andis et al. | 219/370 |
| 4,712,313 | 12/1987 | Gettleman | 34/97 |
| 5,181,328 | 1/1993 | Bouverie | 34/97 |
| 5,592,749 | 1/1997 | Trimmer | 34/97 |
| 5,613,305 | 3/1997 | Narrin | 34/90 |
| 5,761,825 | 6/1998 | Ammon et al. | 34/97 |

*Primary Examiner*—Henry Bennett
*Assistant Examiner*—Pamela A. Wilson
*Attorney, Agent, or Firm*—Robert Samuel Smith

[57] ABSTRACT

A support for a conventional pistol grip hair dryer including a flexible tube with a stiffener rod positioned inside said tube. A clam shell type clamp is secured on one end of the tube for grasping the hair dryer. A tongue bracket is secured on the other end of the tube that may be be detachably engaged with a groove bracket secured to a vertical surface. In another mode of support, the bracket end of the tube with rod bent to a coil as desired and the support is supported on a horizontal surface (table top) in a cobra like arrangement with the dryer held free standing by virtue of the bendable rod inside the tubing.

7 Claims, 1 Drawing Sheet

MULTIPOSITIONAL SUPPORT FOR A HAIR DRYER

FIELD OF THE INVENTION

This invention relates to supports for hair dryers and especially to a wall mounted articulating support that leaves the users hands free during the hair drying procedure.

PRIOR ART AND INFORMATION DISCLOSURE

Washing and drying one's hair is a ritual/necessity practiced regularly by every woman. The lengthiest part (and most boring) of the whole procedure is drying the hair. This part of the procedure is typically accomplished using a hand held hair dryer which the user manipulates by hand to direct the warm air stream against various regions of the scalp. Holding and slowly maneuvering the hair dryer for ten minutes or so is tedious, boring and tiresome. A number of disclosures have appeared related to alleviating the tedium of this chore.

For example, U.S. Pat. No. 4,642,909 to Garcia discloses a hair dryer in which the source of heated air is mounted on a wall and an articulating tube extends from the wall with one end receiving the warm air and the other end directing the warm air to the head of the user.

U.S. Pat. No. 4,659,907 to Andis et al discloses a wall mounted receiver that the user hooks the hair dryer onto when not in use.

U.S. Pat. No. 4,712,313 to Gettleman discloses an articulated arm comprising two arm sections joined end to end by a hinge joint. One end of the joined arms is mounted against a wall. the opposite end of the joined alms is adapted to holding a hair dryer. The range of position for directing the air stream from the dryer that can be achieved with this construction is much more limited than can be achieved using the present invention.

U.S. Pat. No. 5,181,328 to Bouverie discloses a wall mounted hair dryer with a flexible tube having one end receiving warm air from the wall mounted warm air source and the other hand held end issuing warm air. Electric power is switched on when the hand held end is removed from the wall.

U.S. Pat. No. 5,592,749 to Trimmer discloses a hair dryer integrally joined to a corrugated flexible tube whose other end is pluggable into a wall mounted base which is also an electrical outlet. Electric conduits pass from the base through the tube to the hair dryer end of the tube. The flexible tube that is generally available in the market place is not rigid enough to hold the typical hair dryer in an extended position. Trimmer discloses a "rigid pivot arm that is not infinitely flexible but rotates about one or two joints (col. 2, line 61). being a tube containing one or more rigid members joined by a hinge that has only one axis of rotation. (See also FIG. 3 showing a spine having comprising rigid sections joined by a flat hinge).

U.S. Pat. No. 5,630,517 discloses a wall mounted holder for hair styling tools including a hair dryer.

U.S. Pat. No. 5,613,305 to Narrin discloses a floor mounted support for a hair dryer providing adjustable vertical positioning.

None of these devices are a means for a user to direct a hair dryer in an infinite number of orientations leaving her hands free to train the hair.

SUMMARY OF THE INVENTION

It is an object of this invention to provide a support for a hair dryer that supports the hair dryer in any one of an infinite number of orientations selected by a user and directed toward the hair of the user and support the dryer in that orientation leaving both hands of the user free to comb, tease, or brush the hair while the air stream from the dryer drys the hair.

It is another object of the invention to enable the user to use in this operation, any of the hair dryers (typically having a pistol grip) that are available commercially but are too heavy to be supported by holders of the prior art that provide infinitely variable support.

It is another object to be able in one mode to secure the free end of the support to a wall surface with the dryer pointed in a selected direction or, alternatively, to detach the dryer and support from the wall and to configure the support so that the dryer and support are supported free standing on a horizontal surface such as a table top.

This invention is directed toward an elongated articulated arm having one end that is detachably engaged with a mounting bracket that is permanently attached to a convenient location such as a wall. The arm is preferably a corrugated plastic or metal tube with a rigid but bendable (malleable) rod inside the tube. The ends of the rod are free and do not extend outside beyond the ends of the tube so that the rod is entirely contained inside the tube.

In one mode of use, the end of the tube opposite the dryer (free end) is coiled so that the dryer and tube may be positioned like a cobra and be placed on a table with the dryer pointed in the intended direction. In another mode of use, the free end of the tube is plugged into a receptacle on the wall.

The arm-to-wall mounting bracket connection is preferably a tongue and groove construction for quick connect-disconnect. A coupling bracket is mounted on the other end of the arm which detachably engages the "present state of the art hair dryer" which is a "pistol grip" designs. The preferred construction of the coupling device is a split sleeve that opens up to fit around the hair dryer.

In another embodiment, the coupling bracket is an open spring clamp that clamps onto the barrel of the hair dryer.

DESCRIPTION OF ILLUSTRATIVE EMBODIMENTS

Figure 1:
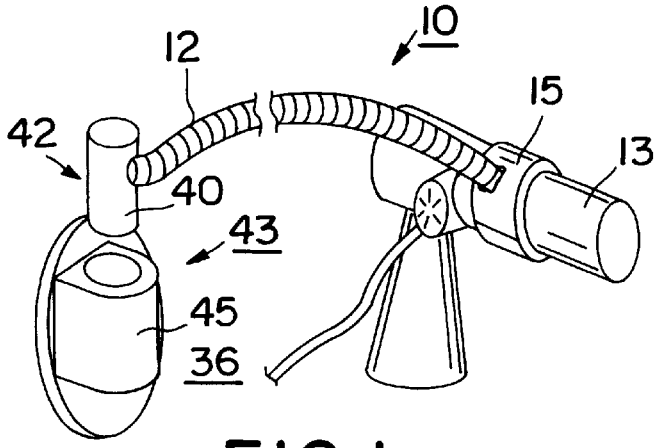
FIG. 1 shows a perspective assembly view of the invention.

Turning now to a discussion of the drawings, FIG. 1 is an assembled perspective view of the invention 10. showing an elongated "semi-flexible" arm 12. with a hair dryer 13 coupled by coupling bracket 15 to one end of the semiflexible arm 12 In the context of this specification, the term "infinitely semi-flexible" is defined as meaning an arm that can be manually bent to any desired shape to point in all direction and will retain that shape when supporting the weight of the dryer.

The shape is retained until the rod is "rebent" to another shape.

Figure 3:
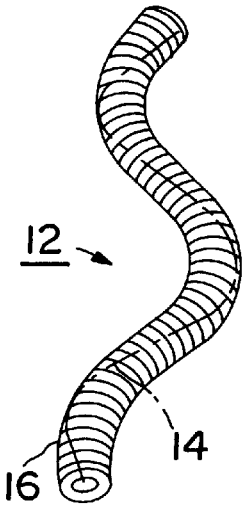
FIG. 3 shows the stiffening wire (in phantom) in the corrugated tube.

Various forms of flexible tubing, fabricated from corrugated plastic or as flexible steel conduit, are available commercially. However these tubes do not retain their shape once they are released. FIG. 3 is an embodiment of the invention showing the semi-flexible arm in which a heavy (3/32 inch diameter) soft steel malleable rod 14, (shown in phantom in FIG. 3 ) is inserted through commercially available flex tube 16 thereby conferring the property of "semi-flexibility" on the tube. The rod extends substantially from one end of the semiflexible tube to the other end of the semiflexible tube. The wire is sufficiently large and dutile to provide that semiflexible tube will retain the shape into which it is bent until it is rebent.

The property of semi-flexibility is an important feature of the invention since it enables the user to repeatedly adjust the position of the hair dryer and to retain that position until that section of the scalp has been dried after which, the aim is reshaped to direct the warm air stream to a different location on the scalp.

FIG. 1 shows one end of the "semi-flexible" aim 12 detachably attached to a wall surface 36 by a mounting means 43 including a tongue member 42 attached to a stub 40. Stub 40 slides permanently into the open end of semi-flexible tube 12. Rod member 42 slides into a tube stub 45 mounted on the wall 36 when it is required to temporarily attach the device on the wall.

Figure 2:
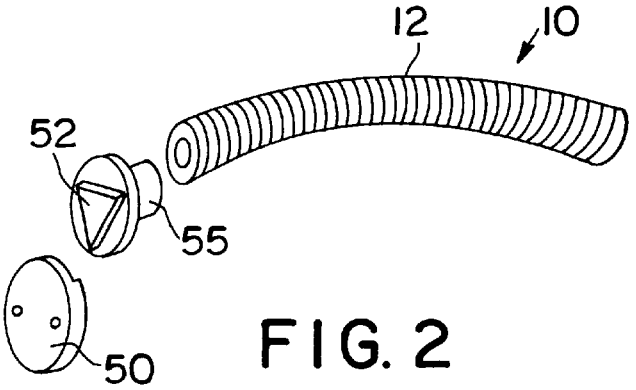
FIG. 2 shows an exploded view of the invention.

FIG. 2 shows another embodiment in which the wall bracket is a groove member 50 that is bolted to a surface (not shown) and detachably mates with a tongue member 52 that is permanently attached to the end of the "semi-flexible" arm opposite the hair dryer by stub 55 sliding into the open end of semiflexible tube 12.

Figure 4:
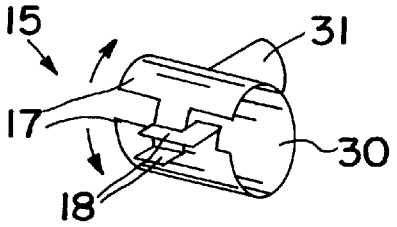
FIG. 4 shows one dryer clamping mechanism.

An embodiment of the coupling bracket 15 for coupling the semiflexible tube 12 to the hair dryer is shown to best advantage in FIG. 4. as being a coupling tube (30) made of resilient material and which is split lengthwise to define pair of jaws 17 that are normally clamped together but that are spread by squeezing a pair of tabs 18 permitting insertion of the barrel of a hair dryer into the coupling tube 30. In the context of this specification, the adjective, resilient, should be understood as meaning "capable of returning to an original shape". Clamping takes place when the tabs 18 are released. The coupling bracket 15 is mounted to the end of the flexible tube by inserting the short stub 31, shown on the rear side of the resilient split tube 30. into the end of the semiflexible tube 12.

Figure 5:
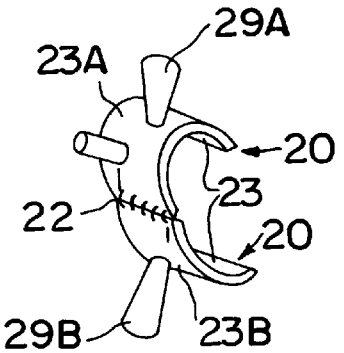
FIG. 5 shows another dryer clamping mechanism.

FIG. 5 shows another embodiment in which the the coupling bracket comprises a coupling tube 2 split to form two hemicylinders, 23A and 23B, and defining a coupling tube 23, split to form two hemicylinders and defining a pair of jaws 20 opposite two straight edges 27. A spring loaded hinge (22) joins the pair of hemicylinders 23A and 23B opposite the jaws 20. Handles are shown for spreading the jaws 20 to permit sliding a dryer between the jaws 20.

Figure 6:
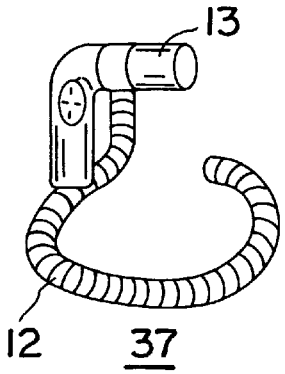
FIG. 6 show the drying support detached from the wall free standing and supported on a horizontal surface.

FIG. 6 shows the support for the hair dryer detached from the mounting bracket on the wall and having an end section 39 coiled up and supported on a flat horizontal surface 37 such as a table top when such support is convenient. The support will retain its shape and support the hair dryer in the upright free standing position by virtue of the strength provided by the bent rod inside the tube.

There have been shown various embodiments that illustrate principles of the invention and which satisfy the objects of the invention. An important feature is a semiflexible arm that may be manually shaped and then retains that shape until it is reshaped. Variations and modifications ay occur after reading the specification and studying the drawings that are within the scope of the invention. I therefore wish to define the scope of my invention by the appended claims.

What is claimed is:

1. A support means (10) for supporting a hair dryer (13) with a warm air stream directed in a desired direction, and for supporting said hair dryer in one mode by attaching said support means to a vertical wall and for supporting said hair dryer in another mode by resting said support means on a horizontal surface, said support means (10) comprising:

a flexible tube (16);

a rod (14) extending from one end of said flexible tube (16) to an opposite end of said flexible tube (16) inside said flexible tube (16) wherein said rod is sufficiently large and malleable selected in operable combination with said flexible tube (16) to provide that said flexible tube (16) retains a shape into which it is manually bent;

a coupling bracket means (15) on one end of said flexible tube(16) adapted for detachably attaching said hair dryer to said one end of said flexible tube (16);

a mounting bracket (43) on another end of said flexible tube (16) for detachably attaching said another end of said flexible tube (16) to a surface of a wall (36).

2. The support means of claim 1 wherein said tube is corrugated.

3. The support means of claim 1 wherein said tube is metal.

4. The support means of claim 1 wherein said tube is plastic.

5. The support means of claim 1 wherein said coupling bracket means (15) comprises:

a coupling tube (30) which is slit lengthwise to define a pair of jaws (17);

said coupling tube being made of resilient material;

a pair of tabs (18), one said tab of said pair of tabs extending from one of said pair of jaws away from said coupling tube and another said tab of said pair of tabs extending from another one of said pair of jaws away from said coupling tube operably arranged to provide that when said tabs are squeezed toward one another, said jaws separate permitting the hair dryer to be inserted in said coupling tube and when said tabs are released, said jaws come together clamping said hail dryer;

means (31) for mounting said coupling tube onto an end of said flexible tube.

6. The support means of claim 1 wherein said coupling bracket comprises:

a coupling tube (23) split to form two hemicylinders and defining a pair of hemicylinders forming a pair of jaws on one side of said coupling tube;

a spring loaded hinge (22) joining said pair of hemicylinders opposite said jaws;

a pair of handles (29A, 29B), one said handle of said pair of handles extending from one said hemicylinder away from said tube and another said handle of said pair of handles extending from another said hemicylinder away from said coupling tube operably arranged in combination with said coupling tube and said spring loaded hinge to provide that when said handles are forced away from one another, said jaws separate permitting a barrel of a dryer to be enclosed in said coupling tube and when said handles are released, said jaws clamp onto said hair dryer;

means (31) for mounting said coupling tube (30) onto an end of said flexible tube.

7. The support means of claim 1 wherein said rod (14) has a thickness and malleability selected to permit coiling an end section (39) of said flexible tube distal from said hair dryer and supporting said coiled end section on a horizontal surface with a remainder of said flexible tube (16) vertical and supporting said hair dryer.

* * * * *